US006487386B1

(12) United States Patent
Zimmer et al.

(10) Patent No.: US 6,487,386 B1
(45) Date of Patent: Nov. 26, 2002

(54) DEVICE FOR APPLYING DECORS AND/OR CHARACTERS ON GLASS, GLASS CERAMICS AND CERAMICS PRODUCTS

(75) Inventors: Michael Zimmer, Saabruecken (DE); Waldemar Weinberg, Kiebitzreihe (DE); Petra Auchter-Krummel, Vendersheim (DE); Dieter Jung, Daaden (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/830,278

(22) PCT Filed: Oct. 21, 1999

(86) PCT No.: PCT/EP99/07989

§ 371 (c)(1),
(2), (4) Date: Jun. 18, 2001

(87) PCT Pub. No.: WO00/25182

PCT Pub. Date: May 4, 2000

(30) Foreign Application Priority Data

Oct. 27, 1998 (DE) ..... 198 49 500
May 8, 1999 (DE) ..... 199 21 321

(51) Int. Cl.[7] ..... G03G 15/16
(52) U.S. Cl. ..... 399/297; 399/308; 399/311
(58) Field of Search ..... 399/297, 302, 399/318, 311, 312, 313; 430/126

(56) References Cited

U.S. PATENT DOCUMENTS 5,701,567 A 12/1997 Bucks
5,948,471 A * 9/1999 Zimmer ..... 106/426

FOREIGN PATENT DOCUMENTS

| | | | |
|---|---|---|---|
| DE | 44 13 168 C2 | | 1/1996 |
| DE | 197 18 303 C1 | | 7/1998 |
| EP | 0 249 385 A2 | | 12/1987 |
| EP | 0 453 762 A2 | | 10/1991 |
| EP | 0 760 495 A | | 3/1997 |
| EP | 0 834 784 A | | 4/1998 |
| EP | 0 834 784 A1 | | 4/1998 |
| JP | 62-17757 A | * | 1/1987 |
| JP | 5-61361 | | 12/1993 |
| JP | 08-146819 A | | 6/1996 |
| JP | 9-218593 A | * | 8/1997 |
| WO | 96/34319 | | 10/1996 |

* cited by examiner

*Primary Examiner*—Joan Pendegrass
(74) *Attorney, Agent, or Firm*—Michael J. Striker

(57) ABSTRACT

The device for applying decorations and characters on glass, glass ceramic or ceramic products includes an image roller (5) provided with an electrostatically chargeable photoconductive layer; a photo-exposure assembly (6) for generating an electrostatic charge image corresponding to at least one of decorations and characters to be applied; a supply container (8) for a toner with a device **(8*a*) for developing the electrostatic charge image with the toner; a dimensionally stable transfer roller (7) for receiving the toner image, which is in direct contact with the image roller on one side and with the product (2) on its other side; at least two coronas (9, 10) including a first corona (9) arranged on the transfer roller (7) and a second corona (10) arranged under the product near the transfer roller (7)** and a heater for burning the toner image onto the product, after electrostatically transferring the toner image to the product by means of the coronas.

13 Claims, 2 Drawing Sheets

DEVICE FOR APPLYING DECORS AND/OR CHARACTERS ON GLASS, GLASS CERAMICS AND CERAMICS PRODUCTS

BACKGROUND OF THE INVENTION

1. Field of the Invention

The invention relates to a device for applying decorations and/or characters on glass, glass ceramic or ceramic products using electrophotography, having:

an image roller, which has an electrostatically chargeable photoconductive layer, a photo-exposure assembly for generating an electrostatic charge image corresponding to the decorations and/or characters to be applied, a supply container for a preferably ceramic toner and devices for developing the electrostatic charge image with this toner, an intermediate substrate, which is in direct contact on one side with the glass, glass ceramic or ceramic product and is embodied such that it receives the toner image, and on the other side is in direct contact with the glass, glass ceramic or ceramic product, at least two coronas, of which the first corona is disposed on the intermediate substrate and the second corona is disposed in the region of the contact zone of the product with the intermediate substrate, and having heating means for burning in the toner image, electrostatically transferred by means of the coronas, onto the product.

2. Related Art

To glass, glass ceramic or ceramic products, decorations are applied within a wide scope to achieve desired aesthetic impressions. In certain products, captions, identification codes or the like must also be applied, for instance in order to give the user the requisite information directly. A typical example that can be named is the glass ceramic plate for a stove burner area, which along with the trademark, such as Ceran®, also has other operating and status indications, and in accordance with customer wishes, decorations, especially decorations in color, as well.

For applying such decorations and/or characters, which are designated herein by the term "images", various methods and devices are known, of which two have thus far gained significance in the industry.

In the first typical method, ceramic dyes are imprinted using current printing techniques directly to the glass and ceramic products; the dye is first dried to the point of being wipe-proof and then burned in; in the case of the aforementioned glass ceramic plates for burner areas, the burning in of the dye typically takes place during the ceramization. In that case, the imprinting is therefore not done onto the finished glass ceramic plate but already on the green product to be ceramized.

In screen printing, which is generally used for the aforementioned printing process, a screen printing template must first be produced. To that end, the screen of fine-mesh textile or wire cloth, which is fastened over a printing frame, is covered at the image-free places with a template cut out of paper, drawn using greasy ink, or produced photographically. By means of this screen printing template, the ceramic dyes are then applied directly to the glass or ceramic product. The production of the screen printing template in the known method is very complicated and uneconomical for individual production of single items. Furthermore, with the aid of a scraper, the printing ink must be applied through the open places in the screen printing template either manually or in screen printing machines. Screen printing is also a wet process, in which ceramic dye pigments pasted up with printing oil are used as printing ink, so that relatively large, expensive machines with driers are required, and furthermore, there are major problems of worker protection and environmental pollution, especially because of the solvents required in the production process. The solvents in the printing oil evaporate relatively easily, so that complicated, expensive worker protection provisions must be made, and besides, separate filtering systems are required. Moreover, in screen printing as in offset printing, a plurality of printing operations in succession for the various colors (such as cyan, magenta, yellow and black) are needed, which again leads to very large systems. In the known printing processes there is also the problem that reproducibility of colors can not be assured in large-scale mass production, and furthermore, after even a small number of items have been produced, that is, after about one hundred printing operations, the screen printing template must be cleaned.

In addition, in screen printing the resolution of the colored imprint made is limited by the screen mesh of the screen printing template. As a result, the printed ceramic or glass products are often unsatisfactory with regard to smoothness, homogeneity, and the resolution of the color imprint. Furthermore, if a desired quality is to be achieved, various special inks must often be used.

In the second typical method, ceramic dyes are not applied directly to the glass and ceramic products but rather to a transfer means, such as a paper coated with gum arabic. This transfer means, thus prepared, is then placed on the ceramic or glass product at the desired position and moistened; as a result, the paper can be removed, leaving the inks behind on the product. Finally, the product is then fired in a manner known per se, which causes the ceramic inks to fuse to the product. Once again, this achieves a permanent imprint on the ceramic or glass product.

This second typical method works on the principle of the decal. It is known for the ceramic inks to be applied to the transfer means using current printing techniques, especially screen printing, but this has the aforementioned disadvantages of screen printing.

It has therefore also been disclosed by German Patent DE 44 13 168 C2 that instead of conventional ceramic printing inks, a novel ceramic toner be used, that is, ceramic dye compositions that comprise fine particles of ceramic pigments, fluxing agent (glass), binder resin(s) in typical additives, and which are applied to the transfer means using an electrophotography reproduction process (electrocopying process). With the aid of these provisions, a method for producing decorated successfully be created aforementioned problems. A decorated ceramic and that is superior to known products in terms of the fineness and resolution of the decoration (imprint).

The known method also enables a simplified application of the images to the transfer means. By acquisition of the data of the desired image to be applied to the ceramic or glass product, for instance using a digital color scanner or by using original graphic data and transferring these data using a personal computer to the image memory of the electrophotographic reproduction device, such as a laser printer, the user is advantageously for the first time given the capability of making changes, for instance in color graduation, or rastering, without additional effort even if the numbers being produced are quite low. In addition, all the graphics and/or modifications that are possible with modern computer technology can be transferred directly to the transfer means.

The decisive disadvantage of this known method is that a transfer means is required in conjunction with further method steps, in order to apply the image from this transfer means onto the glass or ceramic product. Aside from the additional expense for producing the images on the product, there is also the risk that the images on the moistened transfer means will slip when the substrate is applied and peeled off, a problem that is quite familiar from decals, so that the images are applied distorted, which then does not meet the required tolerances for the colored product.

A comparable electrophotographic reproduction process for applying images to tiles using a transfer means has been disclosed by international patent disclosure WO96/34319, for which the described disadvantages apply to the same extent.

From the patent literature, methods for applying decorations and/or characters to glass, glass ceramic or ceramic products (substrates) have also become known in which no transfer means as in the decal method is employed; in other words, methods in which the decorations and/or characters are applied directly to the substrate.

German Patent DE 197 18 303 C1, for instance, describes a method for producing a glass disk provided with a colored image or decoration, in which an original of the multicolored image or decoration is applied to a painted underlay and is transferred to the glass disk with the aid of a reproduction system, comprising a color-scanner, image processing software, and a color plotter in the form of an ink jet plotter, using baking inks in the ink jet plotter. The inks applied are then fired at an elevated temperature.

This method has the disadvantage that the inks applied to the glass substrate by the ink jet plotter begin to run while being applied to the hydrophobic glass surface, so that images that are decorations with sharp contours cannot be produced.

European Patent Disclosure EP 0 834 784 A1 also describes an apparatus for applying decorations and/or characters to glass or ceramic products using electrophotography. This apparatus comprises the following:

- an image roller, which has an electrostatically chargeable photoconductive layer,
- a photo-exposure assembly for generating an electrostatic charge image corresponding to the decorations and/or characters to be applied,
- a supply container for a ceramic toner and devices for developing the electrostatic charge image with this toner,
- an intermediate substrate in the form of an endless belt or a transfer roller, which is in direct contact on one side with the image roller and picks up the toner image, and which on the other side is in direct contact with the glass or ceramic product, so as to transfer the toner image from the intermediate substrate directly onto the glass or ceramic product.

The transfer of the toner image, applied to the intermediate substrate, to the glass or ceramic product is done in such a way that by suitable heating devices, on the one hand the intermediate substrate in the contact zone with the glass or ceramic product is heated to a temperature of at least 100° C., and on the other, the glass ceramic product is heated to a temperature of at least 60° C.

In this heat transfer method, the toner on the intermediate substrate is brought to the molten state, and the molten toner is then transferred to the glass or ceramic product. Because of this melting process, however, the toner and thus the charge image runs somewhat, so that in this method as well, the contour sharpness leaves something to be desired. Moreover, it is not readily possible to remove the molten toner completely from the intermediate substrate, so that there is a risk that ghost images will be carried along.

From Japanese Patent Disclosure JP 08-146819A, a method for applying decorations and/or characters to glass, glass ceramic or ceramic products using electrophotography, and an associated apparatus, are known which make possible sharp-contour copying without the risk of ghost images.

This known method employs the following steps:

- exposing a rigid substrate, provided with a photoconductive layer, to light in accordance with the decorations and/or characters to be applied, creating a corresponding latent electrostatic charge image, developing this electrostatic charge image with a toner that comprises ceramic pigments encased by a binder to produce a corresponding toner image,
- transferring the toner image to an intermediate substrate,
- transferring the toner image on the intermediate substrate to the glass, glass ceramic or ceramic product using an electrostatic field, and
- burning in the electrostatically transferred toner image.

This known method is performed by a device, having

- an image roller, which has an electrostatically chargeable photoconductive layer,
- a photo-exposure assembly for generating an electrostatic charge image corresponding to the decorations and/or characters to be applied,
- a supply container for a preferably ceramic toner and a device for developing the electrostatic charge image with this toner,
- an intermediate substrate in the form of an endless belt, which is in direct contact on one side with the image roller and is embodied such that it picks up the toner image, and which on the other side is in direct contact with the glass, glass ceramic or ceramic product,
- at least two coronas, of which the first corona is disposed on the endless belt and the second corona is disposed in the region of the contact zone of the product with the endless belt, and having
- heating means for burning in the toner image, electrostatically transferred by means of the coronas, onto the product.

In the case of the aforementioned JP 08-146 819 A, an endless belt is provided as the intermediate substrate. Intrinsically, an endless belt such as this has a certain flexibility and is therefore subject to deformation from contact with the image roller and the product and is therefore unstable and thus not true to form as is required if an undistorted and in particular large-area image that meets high tolerance requirements is to be applied to the product.

Furthermore, in the known case, the second corona is disposed on the product next to the contact zone between the endless belt and the product, and as a result the electrostatic transfer of the intermediate image on the endless belt to the product leaves something to be desired.

SUMMARY OF THE INVENTION

The object of the invention, based on the aforementioned device known from JP 08-146 819 A and 25 defined at the outset, is to embody this device such that it is possible to apply an undistorted and in particular large-sized image, which meets high tolerance requirements, to the product.

This object is attained according to the invention in that the intermediate substrate is formed by a dimensionally stable transfer roller, and that the second corona is disposed beneath the product, directly in the contact zone.

If a suitably undistorted image, which meets high tolerance requirements, is to be transferred to the product, in particular large-sized products (0.25 $m^2$), it is critical to achieve the most true-to-form and stable embodiment of the intermediate substrate medium. According to the invention, this is best achieved successfully by the use of a rotationally symmetrical, rigid body, that is, the transfer roller. The transfer roller is not subject to deformations the way the endless belt is.

Because the second corona is disposed beneath the product, directly in the contact zone between the transfer roller and the product, the electrostatic transfer of the intermediate image located on the endless belt to the product is improved significantly.

In a refinement of the invention, the device is expediently embodied such that beneath the product in the contact zone with the transfer roller, a counterpart roller, embodied as a hollow roller, is disposed in direct contact with the product, and the second corona is disposed in the interior of the counterpart roller, on its surface in the region of the contact zone; and that the first corona at the transfer roller is disposed in the contact zone with the image roller and has a potential that is opposite the charge of the toner image on the image roller; and that a further, third corona, which has an opposite potential from the first corona and the second corona in the counterpart roller, is disposed on the transfer roller in the contact zone with the product.

This provision makes for an improved transfer of the electrostatic toner image on the image roller by way of the transfer to the product.

For an optimized transfer of the toner image to the product, along with an optimal disposition of the coronas, the embodiment of the transfer roller also has decisive significance, on the one hand because it is in direct contact with the hard, glassy products, and on the other because the material used for it affects the electrostatic fields, which are definitive for the transfer of the charged toner image.

To meet these conditions, it is necessary for the transfer roller to be a hollow roller, in whose interior at least one corona is mounted.

In a first refinement of the invention, the device is made such that the transfer roller embodied as a hollow roller has an electrically insulating core of plastic, preferably a glass-fiber- or carbon-fiber-reinforced plastic; and a relatively soft layer of electrically conductive silicone, EPDM or other suitable plastics or rubber mixtures is applied to the core; and that in the interior of the transfer roller, the first, upper corona is disposed in the contact zone with the image roller, and the third, lower corona of opposite potential is disposed in the contact zone with the product.

A transfer roller constructed in this way makes it possible, because of its electrically insulating core, for the coronas to be disposed in the interior of the transfer roller. The electrostatic transfer processes take place solely in the outer conductive layer, which is relatively soft and therefore assures good contact with the solid, in particular glassy products.

In a second refinement of the invention, the device is embodied such that the transfer roller embodied as a hollow roller has a core of metal material, preferably aluminum, onto which a first layer of insulating silicone or similar materials is applied; and that onto this fundamental structure, a relatively soft layer of electrically conductive silicone, EPDM or other suitable plastics or rubber mixtures is applied; and that the first, upper corona is disposed in the contact zone with the image roller and the third, lower corona of opposite potential is disposed in the contact zone with the product, in each case outside the transfer roller.

In this kind of embodiment, because of the shielding effect of the metal core, the coronas are disposed outside the transfer roller in the contact regions. In this embodiment as well, the electrically effective processes take place in the conductive, soft layer, which is electrically insulated from the metal core by the first layer of insulating material, so that the electrostatic charge image develops solely in the outer, soft layer.

Good results in terms of both electrostatics and in terms of the contact with the hard, glassy products are attained if in one feature of the invention, the layer of electrically conductive material, preferably silicone, has a hardness in the range of 50 Shore A with a specific internal resistance in the range of 10 kOhm/cm and a thickness in the range of 5 mm. Other values are fundamentally conceivable as well.

To reduce abrasion from the transfer roller, in a further feature of the invention, the layer of electrically conductive material is covered with a very thin, conductive Teflon® layer or some other suitable coating. This layer increases the sliding capacity without markedly changing the electrostatic conditions.

The first layer of insulating material, which in the second embodiment of the transfer roller having a metal core is applied to that core, preferably has a thickness that is in the range of 2 mm. This layer thickness suffices to insulate the outer, conductive layer electrically and is not excessively heavy. However, the invention is not limited to this value.

In a further embodiment of the invention, the device is embodied such that the counterpart roller has a metal core, preferably of aluminum, onto which a relatively soft layer of insulating material, such as silicone, is applied; this layer, like the comparable layer of the transfer roller, also has a hardness in the range of 50 Shore A and a thickness in the range of 5 mm.

Such an embodiment pays due attention to both the electrostatic and the mechanical conditions, but the invention is not limited to these values.

BRIEF DESCRIPTION OF THE DRAWING

The invention will be described in further detail in terms of two exemplary embodiments of the device according to the invention shown in the drawings, in which.

DETAILED DESCRIPTION OF THE INVENTION

Figure 1:
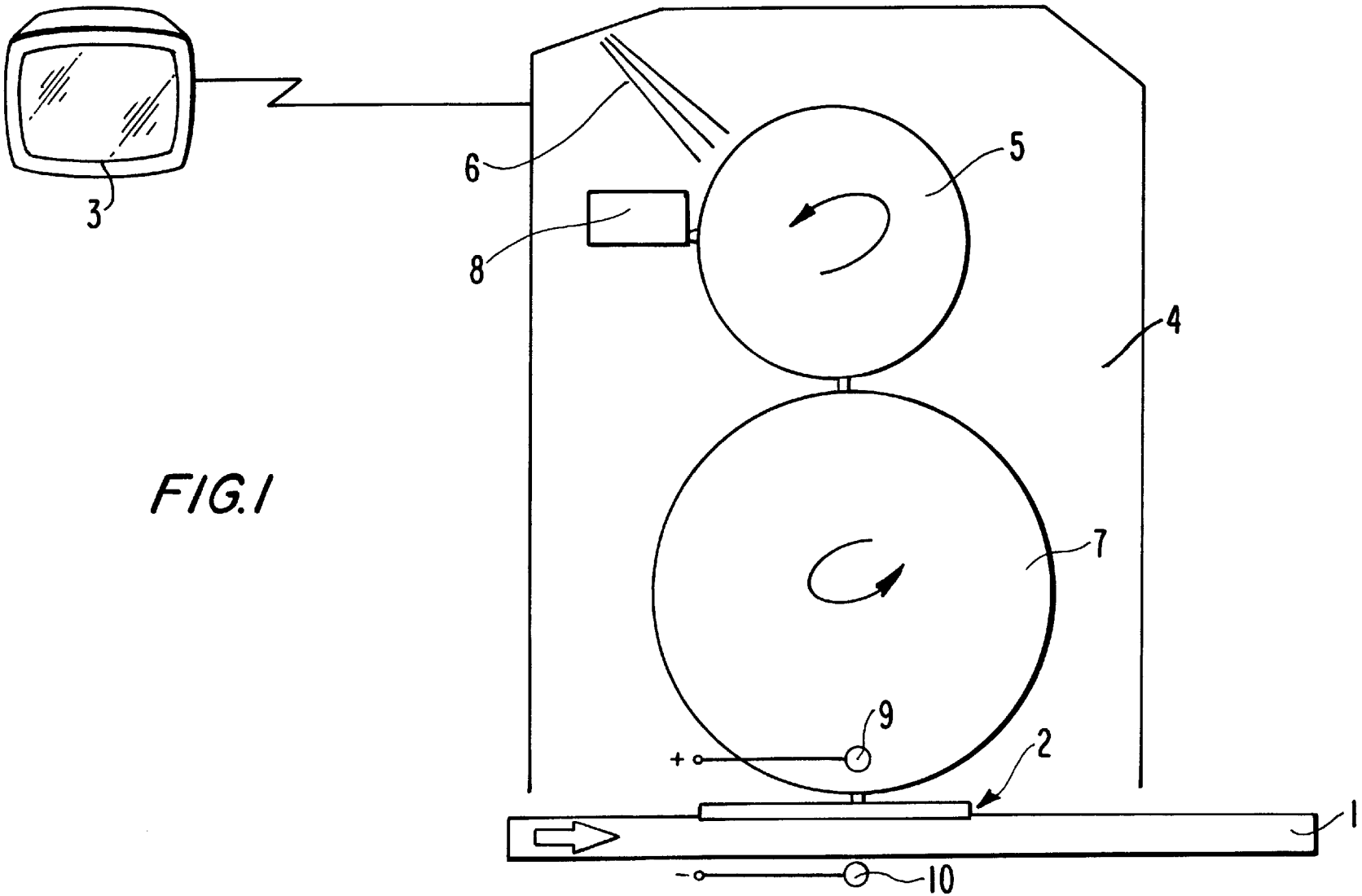
FIG. 1 is a schematic plan view illustrating the fundamental principle of the device of the invention.

In the basic illustration in FIG. 1, glass, glass ceramic or ceramic products 2, such as tiles or glass ceramic plates for stovetop cooking areas or burners, onto which a decoration and/or captions and/or identifying codes, that is, "images", are to be applied, are located on a conveyor belt 1. The design of the decoration to be applied or of the text for the caption or the identifying code is delivered by a personal computer 3 to an electrocopying device 4, whose basic design will be described in further detail hereinafter.

The corresponding images can be specified in the original by the computer in the context of corresponding graphic or text programs. However, it is also possible for the decorations or captions and identifying codes to be applied to be captured from an original into the computer using a scanner; in the computer, they can be modified if desired.

The electrocopying device 4 typically comprises an image roller 5, which is provided with a photoconductive layer that is exposed to light via a corresponding photo-exposure assembly 6, for instance by means of a controlled laser beam, in accordance with the decoration or caption to be applied. In a known manner, this creates a "latent" electrostatic charge image. By means of a ceramic toner delivered from a supply container 8, of the kind disclosed in DE 44 13 168 C2 cited above, which in this respect is hereby incorporated by reference in the present application, the latent electrostatic charge image located on the image roller 5 is developed into a visible toner image, which is then transferred to a transfer roller 7 with a flexible surface. After that, the toner image on the transfer roller 7 is transferred directly onto the glass or ceramic product 2. This transfer is done with the aid of an electrostatic field, which is created by the application of a voltage to two so-called coronas 9, of which one corona 9 is disposed inside the transfer roller 7, and the other corona 10 is disposed under the substrate 2, directly in the contact zone. In the simplest case, the coronas can be formed by a wire.

After that, the electrostatically transferred toner image is fired on the product using conventional methods.

By means of the electrostatic field generated, the btoner image located on the transfer roller 7 is transferred highly exactly onto the substrate 2. Tests have shown that this takes place without residue, so that preparation of the transfer roller 7 for the transfer of the next charge image from the image roller 5 is made simpler, and there is no risk that ghost images will be created that are dragged into the next copy.

The transfer roller 7 can by way of example be made of glass-fiber-reinforced plastic (GFK), polyethylene, or similar suitable materials. This transfer roller is advantageously embodied as hollow on the inside, so that coronas that perform the transfer of the toner to the substrate can be mounted on the inside. On the surface of the transfer roller 7, it has proved to be advantageous to apply a layer, by a means known per se, that comprises a material which carries the toner but upon corona discharge allows a residue-free transfer of the toner. The use of a silicone rubber as a coating material has proved advantageous in this respect. However, still other materials with suitable physical properties may also be employed. By means of this coating, the surface of the transfer roller also gains a certain elasticity, which however does not cause any distortion in the transfer, and this also has favorable effects in terms of the contact formation.

The construction and mode of operation of the image roller 5 and toner supply 8, which are the essential components in electrophotography or xerography, are fundamentally known and therefore need not be explained in detail here.

By the provisions according to the invention, it has been successfully possible for the first time, in a surprising and advantageous way, using means of electrophotography, to provide glass and ceramic products directly, or in other words without transfer means in the sense used in decal technology, with decorations and/or characters, in particular of large-area, without distortion.

Figure 2:
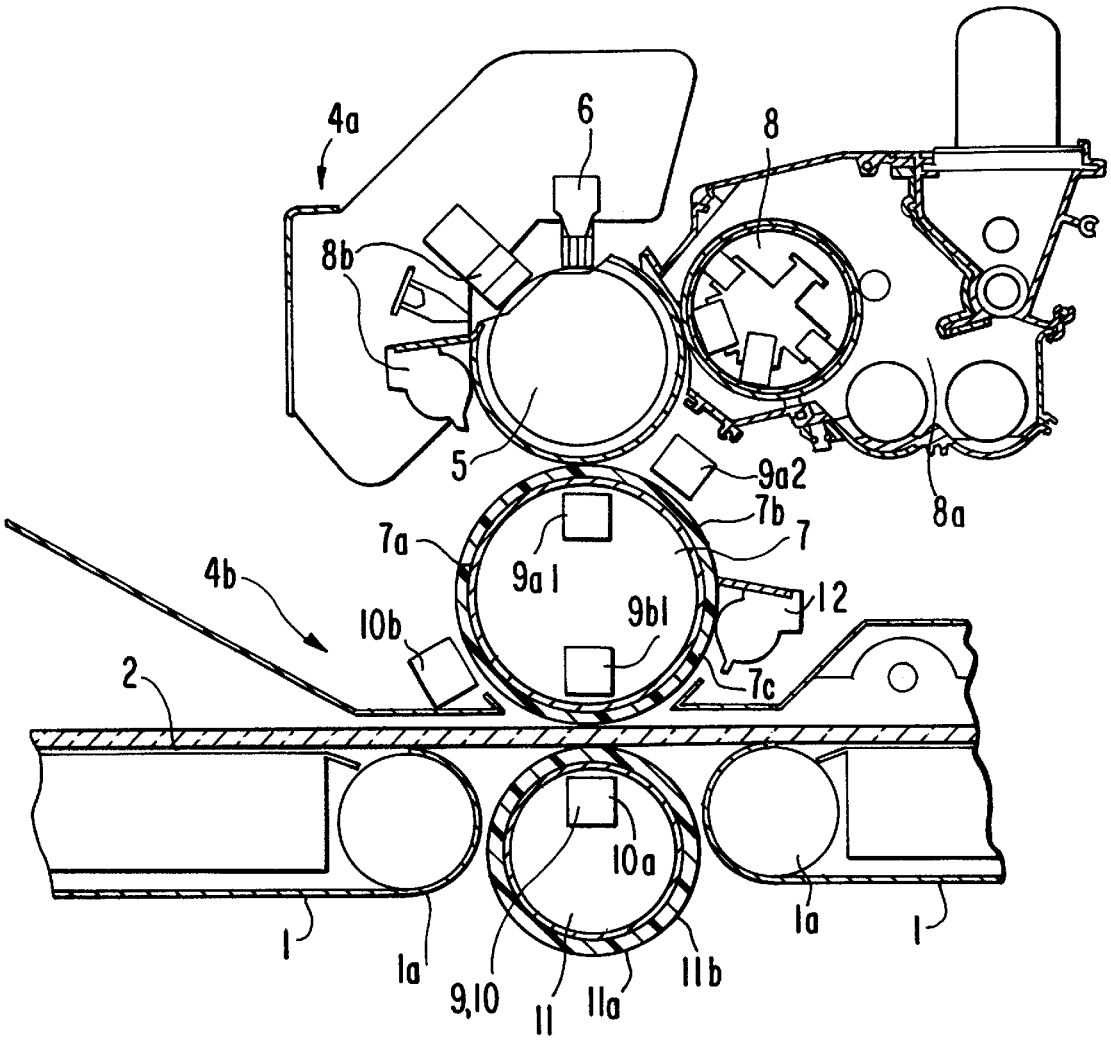
FIG. 2 is a schematic sectional view of a concrete embodiment of the device according to the invention, with two variants pertaining to the transfer roller of the corona assembly.

In FIG. 2, an embodiment of the invention is shown that is designed in greater detail structurally compared with the basic illustration in FIG. 1. Elements that agree with or function the same as those in FIG. 1 are provided with the same reference numerals.

The glass, glass ceramic or ceramic products 2, such as tiles or glass ceramic plates for stovetop cooking areas, onto which a decoration and/or captions and/or identifying codes are to be applied, are located on the conveyor belt 1, which is driven by feed rollers 1*a*.

The electrocopying device shown in FIG. 2 for applying these decorations and so forth likewise comprises two main component groups, that is, the electrophotographic system 4*a* and the transfer system 4*b*.

The electrophotographic system 4*a* includes as its central constituent an image drum 5, that is, an OPC photoconductor drum, which is provided with a photoconductive layer, which is exposed to light via a suitable, preferably digitally designed photo-exposure assembly 6, such as a controlled laser beam, or more simply an LED writing head, for instance with a resolution of 400 dpi for a writing width of 36", depending on the decoration or caption to be applied. In a known manner, this produces a "latent" electrostatic charge image.

The electrophotographic system 4*a* further includes a developer unit 8*a* with a preferably ceramic and in particular two-component toner system, of the kind disclosed for instance in the above-cited German Patent DE 44 13 168 C2, by means of which the latent electrostatic charge image on the image drum 5 is developed into a visible toner image. Still other suitable, special toners and pigments can be employed. As is usual in the electrophotographic method, this developer unit 8*a* includes a supply container 8 for the toner, in conjunction with the usual means for applying the toner to the image drum 5. The electrophotographic system 4*a* also has a typical cleaning and erasing unit 8*b*, for removing adhering toner from the image drum 5.

The toner image created on the image drum 5 in accordance with the image to be applied is then transferred to the product 2 by the transfer system 4. This transfer system 4 has three main components: the transfer roller 7, a plurality of coronas 9, 10 by which an electrostatic field for transfer of the toner image can be created by application of a voltage, and finally a counterpart roller 11.

Two alternative types of construction have proved advantageous for the embodiment of the transfer roller 7.

In the first type of construction, a core 7*a* of electrically insulated glass-fiber- or carbon-fiber-reinforced plastic (GFKICFK) is provided. Over this core 7*a*, a relatively soft layer 7*b*, about 5 mm thick, of electrically conductive silicone, EPDM or other suitable plastics or rubber mixtures is applied, with a hardness of about 50 Shore A and a resistance of about 10 kOhm/cm. These values are examples, without the invention being limited to them.

The surface is teflon-coated with a very thin, conductive layer, or is provided with some other suitable coating.

Inside the transfer roller 7, a positive transfer corona 9*a*1 is disposed opposite the line of contact with the image drum 5, and a negative transfer corona 9*b*1 is disposed opposite the line of contact with the counterpart roller 11.

The coating applied to the core carries the toner on one side, but on the other side allows residue-free transfer of the toner upon the corona discharge. The aforementioned use of a conductive silicone rubber as the coating material has proved advantageous here.

In the second type of embodiment, the core 7a comprises a metal material, preferably aluminum.

A layer 7*c*, about 2 mm thick, of insulating silicone or similar materials is applied to the core. A relatively soft layer 7*b*, about 5 mm thick, of electrically conductive silicone or similar materials is applied, as in the first embodiment, to this fundamental structure, with a hardness of about 50° Shore and a resistance of about 10 kOhm/cm. These numerical figures are again merely examples without any limiting character.

The surface is likewise teflon-coated with a very thin and conductive layer or provided with some other coating. A positive transfer corona 9*a*2 is disposed near the line of contact with the image drum 5, and a negative transfer corona 10*b* is disposed near the line of contact with the counterpart roller, in each case outside the transfer roller 7.

The counterpart roller 11 has a core 11*a* of a metal material, preferably of aluminum. Onto this core, an approximately 5 mm thick layer 11*b* of insulating silicone or a similar material is applied, with a hardness of about 60 Shore A. Again, these values are merely examples. Inside the counterpart roller 11, a positive transfer corona 10*a* is disposed opposite the line of contact with the transfer roller 7.

The transfer of the toner image from the image drum 5 to the glassy product 2 by means of the electrostatic field created by the coronas 9, 10 is done as follows:

The toner image, comprising negatively charged toner particles, that is located on the image drum 5 is taken over in the contact zone from the transfer roller 7, which at this point is positively charged by means of the transfer corona 9*a*1.

Within one-half of a rotation of the transfer roller, the positive surface charge changes to a negative surface charge, as a result of the influence of the negative transfer corona 9*b*1.

Since the transfer roller 7 is coated with an electrically conductive material, different voltage potentials can also be achieved at different locations on the surface. The resistance between the two transfer regions, for a typical diameter of the transfer roller 7, is in the range of about 150 kOhm, for instance.

Upon contact between the transfer roller 7 and the glass or ceramic body 2 traveling therethrough, the toner particles are applied to the glass or ceramic body, since its surface has been positively charged via the negative transfer corona 10*a* located in the counterpart roller 11.

The type of construction of the transfer roller 7 allows the requisite, different voltage potentials in the two transfer regions to be adjusted.

Because of the relatively soft coatings of the two rollers 7 and 11, the contact still exists even if the 25 materials 2 to be printed have slight irregularities.

This leads to a uniform, optimal transfer of the toner image to the glass or ceramic bodies 2. The surface of the transfer roller 7 is embodied as quite smooth, so that residual toner particles can be cleaned off using a suitable device 12. This simplifies the preparation of the transfer roller 7 for the transfer of the next charge image from the image drum 5, and there is no risk that ghost images, which Would be dragged along to the next image will be created.

In the final step, the electrostatically transferred toner image is fired by conventional methods on the product 2.

As already mentioned in the parent patent, the ceramic products decorated with the device of the invention pertain in particular to the shaped, fired products made from clay or mixtures containing clay minerals. Other preferred ceramic products also include products of special ceramic materials, such as the most various powdered materials (such as metal oxides), which are also silicate in nature. For example, the ceramic products can be goods made of porcelain, stoneware, or special ceramic materials, such as stearin, rutile, cordierite and ceramet. The ceramic product can also be provided with a glaze before being decorated, or the glaze can be applied after the decoration has been done. Glass and glass ceramic products within the scope of the invention encompass all products made from a glass composition or products with a glass surface. In particular, glass and glass ceramic products will be mentioned that comprise simple and composite silicates of sodium, potassium, calcium, magnesium, aluminum, barium, zinc, and lead. These glasses are created using fire, and the cooled-down melts substantially comprise silicon dioxide, calcium oxide and sodium oxide; special glasses can additionally contain relatively large quantities of boron trioxide, phosphorus pentoxide, barium oxide, potassium oxide, lithium oxide, zirconium oxide, or lead oxide. Silicon dioxide, boron oxide and phosphorus pentoxide are the actual glass formers, which also form the basis of the enamel. Accordingly, the term "glass product" should also be understood to include enamel products.

In general, with suitable special toners, these can be transferred to level, flat substrates of arbitrary materials, such as plastic, rubber, and so forth.

What is claimed is:

1. A device for applying decorations and characters on glass, glass ceramic or ceramic products by means of an electrophotographic method, said device comprising:

an image roller (5) provided with an electrostatically chargeable photoconductive layer;

a photo-exposure assembly (6) for generating an electrostatic charge image corresponding to at least one of decorations and characters to be applied;

a supply container (8) for a toner and means (8*a*) for developing the electrostatic charge image with said toner to form a toner image;

an intermediate substrate comprising a dimensionally stable transfer roller (7) for receiving the toner image, said transfer roller being in direct contact with said image roller on one side thereof and in direct contact with a glass, glass ceramic or ceramic product (2) on the other side thereof;

at least three coronas including a first corona (9*a*1, 9*a*2), a second corona (10*a*) and a third corona (9*b*1, 10*b*), said first corona (9*a*1, 9*a*2) being arranged on said transfer roller (7), said second corona (10*a*) being arranged beneath said product and in the vicinity of a zone of contact of said transfer roller (7) with said product, said at least three coronas comprising means for electrostatically transferring the toner image onto said product (2);

heating means for burning the toner image onto the product, after electrostatically transferring the toner image onto the product; and a counterpart roller (11) embodied as a hollow roller and arranged beneath the product (2) in direct contact with said product (2) in the zone of contact of the product (2) with the transfer roller (7);

wherein said second corona (10*a*) is arranged in an interior of the counterpart roller (11) and on a surface thereof in the vicinity of said zone of contact and said first corona (9*a*1, 9*a*2) on said transfer roller (7) is arranged in a region of contact of the transfer roller (7) with the image roller (5) and has an electrical potential that is opposite in sign to a charge of the toner image on the image roller (5); and wherein said third corona (9*b*1, 10*b*) has an electrical potential of opposite sign from that of the first corona (9*a*1, 9*a*2) and the second corona (10*a*) and Is arranged on the transfer roller (7) in the vicinity of the zone of contact of the transfer roller (7) with the product (2).

2. The device as defined in claim 1, wherein said transfer roller (7) is a hollow roller having an interior and at least one of said coronas is mounted in said interior of the transfer roller (7).

3. The device as defined in claim 2, wherein said transfer roller (7) embodied as said hollow roller has an electrically insulating core comprising a plastic material and a soft layer (7*b*) of electrically conductive silicone, EPDM, plastic or rubber mixtures applied to the core (7*a*); and wherein said first corona (9*a*1) is arranged in the interior of the transfer roller (7) in the region of contact with the image roller (5) and the third corona (9*b*1) is arranged in the interior of the transfer roller (7) in the zone of contact of the transfer roller with the product (2).

4. The device as defined in claim 3, wherein said electrically insulating core comprises a glass-fiber-reinforced plastic or a carbon-fiber-reinforced plastic.

5. The device as defined in claim 3, wherein said soft layer (7*b*) of electrically conductive material has a hardness of about 50 Shore A, a specific internal resistance of about 5 of 10 kOhm/cm and a thickness of about 5 mm.

6. The device as defined in claim 5, wherein said soft layer comprises said silicone.

7. The device as defined in claim 5, wherein said soft layer (7*b*) of electrically conductive material is covered with a conductive layer and said conductive layer comprises a fluorinated hydrocarbon material or a conductive lubricant coating.

8. The device as defined in claim 3, wherein said counterpart roller (11) has a metal core.

9. The device as defined in claim 1, wherein said toner is a ceramic toner.

10. The device as defined in claim 2, wherein the transfer roller (7) embodied as said hollow roller has a metal core (7*a*), a first layer (7*c*) comprising insulating silicone applied on said metal core (7*a*) and a soft layer (7*b*) comprising an electrically conductive silicone applied on the transfer roller (7) over the first layer (7*c*) and wherein the first corona (9*a*2) is arranged in the region of contact of the transfer roller (7) with the image roller (5) outside of the transfer roller (7) and the third corona (10*b*) is arranged in the zone of contact of the transfer roller (7) with the product (2) outside of the transfer roller (7).

11. The device as defined in claim 10, wherein said metal core is aluminum.

12. The device as defined in claim 10, wherein the first layer (7*c*) of insulating material applied to the metal core (7*a*) has a thickness of about 2 mm.

13. The device as defined in claim 10, wherein the counterpart roller (11) has a metal core.

* * * * *